US006519819B2

(12) United States Patent
Suda

(10) Patent No.: US 6,519,819 B2
(45) Date of Patent: Feb. 18, 2003

(54) CINERARY CONTAINER

(76) Inventor: Yoshie Suda, 5-40 Miyacho, Kawaguchishi, Saitama-ken (JP)

( * ) Notice: Subject to any disclaimer, the term of this patent is extended or adjusted under 35 U.S.C. 154(b) by 0 days.

(21) Appl. No.: 09/827,612

(22) Filed: Apr. 5, 2001

(65) Prior Publication Data

US 2002/0010989 A1 Jan. 31, 2002

(30) Foreign Application Priority Data

Jul. 27, 2000 (JP) ..... 2000-226643

(51) Int. Cl.[7] ..... A61G 17/00
(52) U.S. Cl. ..... 27/1; 27/19
(58) Field of Search ..... 27/1, 2, 190; 220/495.06, 220/1.6, 23.89; 229/117.35

(56) References Cited

U.S. PATENT DOCUMENTS 3,735,456 A * 5/1973 Cude ..... 27/17
3,838,482 A * 10/1974 Wallace ..... 27/11
4,648,162 A * 3/1987 Daino ..... 27/1
5,088,167 A * 2/1992 Rahe ..... 27/1
5,619,785 A * 4/1997 Tambussi ..... 29/434
5,655,706 A * 8/1997 Vandiver ..... 229/125.09
5,704,103 A * 1/1998 Crowley et al. ..... 27/1
6,070,718 A * 6/2000 Drabwell ..... 206/216

* cited by examiner

*Primary Examiner*—William Miller
(74) *Attorney, Agent, or Firm*—Frishauf, Holtz, Goodman & Chick, P.C.

(57) ABSTRACT

A cinerary container is provided which includes a main body which is made of metal and one face of which is open, a magnet setting part formed on an inner wall side face of the main body, and a lid body for closing the open face of the main body. A magnet of the magnet setting part is adapted to attract the lid body and to attract a metallic bag body which contains ashes and bones.

7 Claims, 3 Drawing Sheets

CINERARY CONTAINER

BACKGROUND OF THE INVENTION

Field of the Invention

This invention relates to a cinerary container and more particularly to a cinerary container which receives therein ashes of remains and a projection part (Adam's apple or throat bone) of a thyroid cartilage located at an intermediate part of a human throat, and which is then placed on a cinerary altar.

Although it is customary in Japan to bury the remains of a dead person after cremation in a graveyard, other cases are increasing for religious reasons or other reasons such as personal belief, in which ashes are scattered at sea, etc. If related laws are established, the number of such other cases will increase.

Moreover, the number of cinerary altars in cemetaries and temples is increasing, reflecting a shortage of graveyards. In view of the problem of space, the conventional cinerary urn is required to be miniaturized and extra space is required to be eliminated. Moreover, due to demographic changes, permanent memorial services are increasing and tombs for persons who died leaving no relatives are also increasing. Thus, proper processing of ashes and bones is rapidly required.

The present invention has been accomplished in view of the above situation.

SUMMARY OF THE INVENTION

It is, therefore, an object of the present invention to provide a cinerary container which reduces the space necessary for setting (or placing) the cinerary container, which can withstand against rot and offensive smell, which can properly cope with quakes, thereby preventing scattering of ashes and bones, in which a bag containing ashes and bones can be prevented from escaping from the container main body by quakes, and which is especially excellent for use on a cinerary altar.

In order to achieve the above object, there is provided a cinerary container comprising a main body which is made of metal and one face of which is open, a magnet setting part formed on an inner wall side face of the main body, and a lid body for closing the open face of the main body. A magnet of the magnet setting part is adapted to attract the lid body and to attract a metallic part of a bag body which contains ashes and bones. The container is preferably totally subjected to antibacterial and anti-smell treatment. The cinerary container main body may comprise a bottom plate body corresponding to the lid body. And it is preferred that the cinerary container further comprises an oscillation preventive magnet for preventing oscillation of the bag body.

By virtue of the above-mentioned construction, the cinerary container according to the present invention can be re-used in a recyclable manner, and the containers can be placed in more intimate adjacent relation with respect to one another, thus achieving a space saving effect. In addition, the containers are adapted to be closed without sacrificing easy detachability of the lid body, the ashes and Adam's apple contained in the bag body are held stable even against quakes, and the bag body is prevented from escaping from the container main body by quakes.

DETAILED DESCRIPTION OF THE EMBODIMENT

Figure 1:
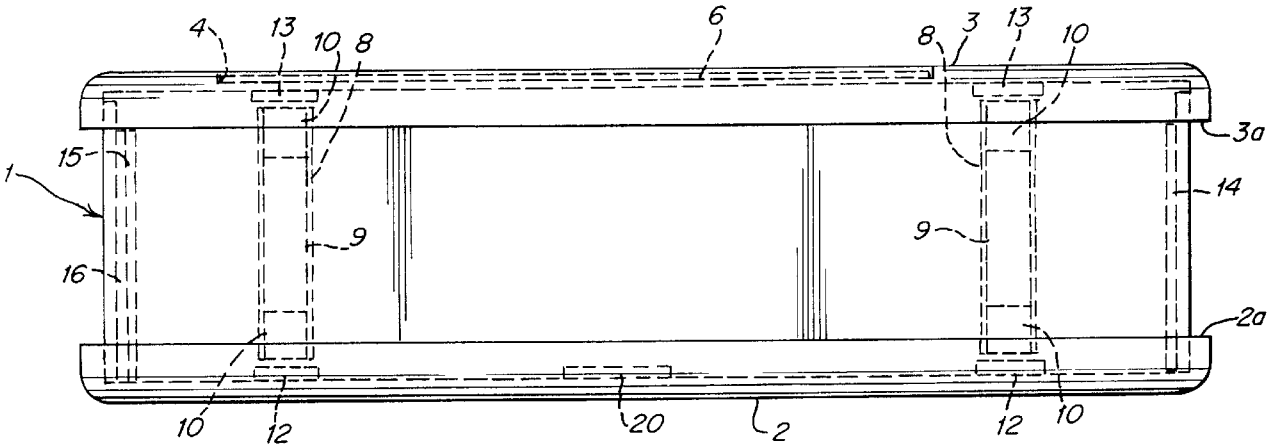
FIG. 1 is a side view of a cinerary container according to one preferred embodiment of the present invention.

One preferred embodiment of the present invention will now be described with reference to the accompanying drawings.

In the drawings, reference numeral 1 denotes a cinerary container main body. The cinerary container main body 1 is made of excitation metal such as steel into a rectangular configuration which is open at least at an upper face thereof. This cinerary container main body 1 includes a lid body, and is preferably subjected to antibacterial and anti-smell treatment by known techniques. It should noted that although the cinerary container main body 1 has a rectangular configuration in this embodiment, the present invention is not limited to this. It may have a conventional urnlike configuration.

The cinerary container main body 1 is provided at a bottom face thereof with a bottom plate 2 which has flange portion 2*a* at a peripheral edge part of the cinerary container main body 1.

On the other hand, the cinerary container main body 1 is provided at an upper face opening thereof with a detachable lid body 3 which has a same configuration as the bottom plate 2 and which likewise has a flange portion 3 at the peripheral edge of the cinerary container main body 1.

A flat recess or concave hole 4 is formed in a top face of the lid body 3 such that the flat recess 4 is offset to one side. A name plate 6, which is made of brass, with letters 5 such as a posthumous buddhist name indicated on an outer face thereof is fixedly fitted to the flat recess 4. The name plate 6 is fixedly fitted to the flat recess 4 by using magnetic sheets 7*a*, 7*b* in the flat recess 4 and on a rear face of the name plate 6 through a double face adhesive tape, for example. By doing so, the name plate 6 is prevented from dropping and the cinerary container can easily be recycled.

Two pairs of magnet setting parts 8 are formed in opposing relation with each other on an inner wall face of the cinerary container main body 1 along a longitudinal direction of the main body 1. The magnet setting parts 8 are formed in a vertical direction and have L-shaped angles in section held in opposing relation.

An aluminum plate 9 is fitted to an intermediate part of each of the magnet setting parts 8, and plate-like magnets 10 are fitted to upper and lower parts of the aluminum plate 9.

Rail-like magnet attachment parts 11 are formed on inner faces of the bottom plate 2 and the lid body 3 in such a manner as to correspond to the magnet setting parts 8. Each magnet attachment part 11 comprises of an angle 11*a* having an L-shaped configuration in section and a projection piece 11*b* projecting inward from the angle 11*a*.

In the magnet attachment part 11, for example, of the bottom plate 2, a rod-like magnet 12 is inserted at a lower part of the angle 11*a* such that the rod-like magnet 12 is linearly confronted with the plate-like magnet 10 through a bent part of the angle 11*a*. Owing to this arrangement, the bottom plate 2 is firmly attracted to the cinerary container main body 1 by a powerful magnetic force.

In the magnet attachment part 11, for example, of the lid body 3, a magnet 13 is retained on the projection piece 11*b* side so that the lid body 11*b* is attracted to the cinerary container main body 1 from the projection piece 11*b* through the angle 11*a*. By doing so, the lid body 3 can be detachably attached to the cinerary container-main body 1 by a weak force as compared with the case of the bottom plate 2.

In the case where the cinerary container main body 1 is placed in an erected manner, a plate-like magnet 14 is disposed over an entire lower face, i.e., the entire inner face remote from the name plate 6 in a short direction. On the inner side of an upper face side of the cinerary container main body 1, a magnet setting part 15, which comprises opposing angles, is formed and there is also provided thereon a plate-like magnet 16 for suspending a bag body 19 which is adapted to contain ashes and bones and which is made of a strong raw material which cannot be pierced or broken by the bones.

In the drawings, reference numeral 20 denotes a belt-like magnet for restraining oscillation of the bag body 19. This belt-like magnet 20 is disposed on the bottom plate 2 side of the cinerary container main body 1, i.e., on the interior of the cinerary container main body 1 which is located at the back side when the main body 1 is in the erected state. It should be noted that although the oscillation preventing magnet 20 is in the form of a belt in this embodiment, the present invention is not limited to this. For example, it may, of course, be in the form of a dot or broken line.

Figure 2:
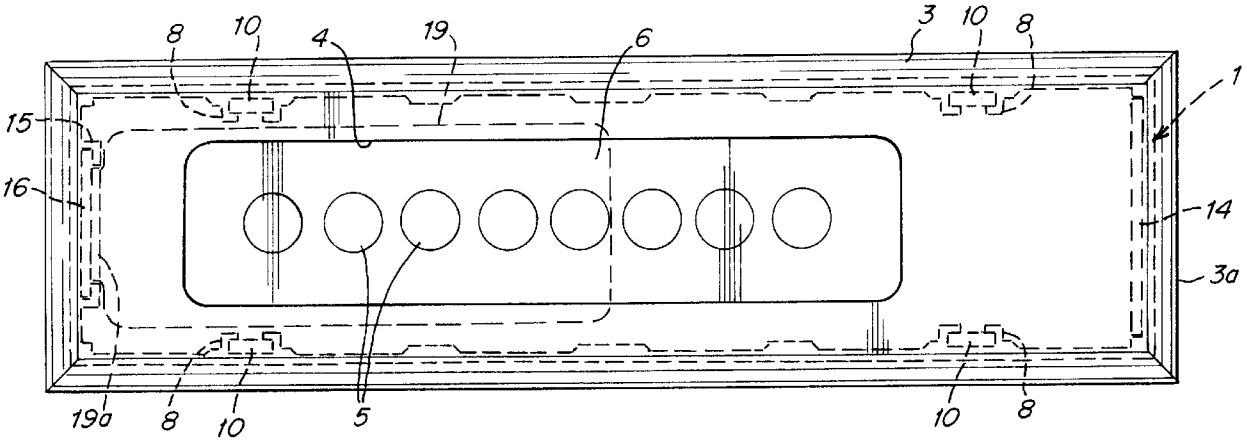
FIG. 2 is a plan view of the same.
Figure 3:
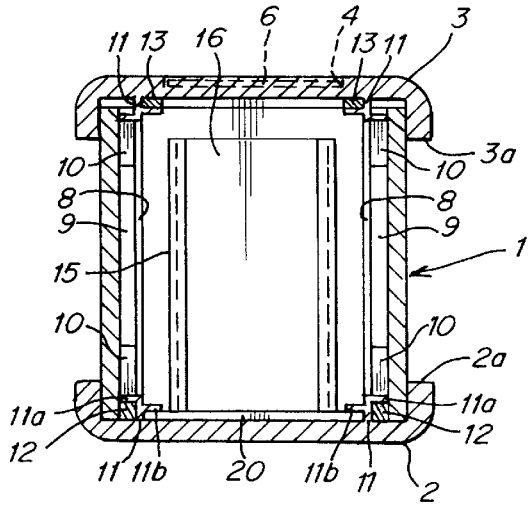
FIG. 3 is a front sectional view of the same.
Figure 4:
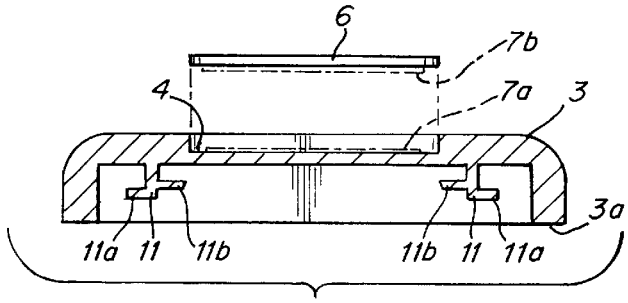
FIG. 4 is a front view in which a name plate is detached and brought away from a lid body.
Figure 5:
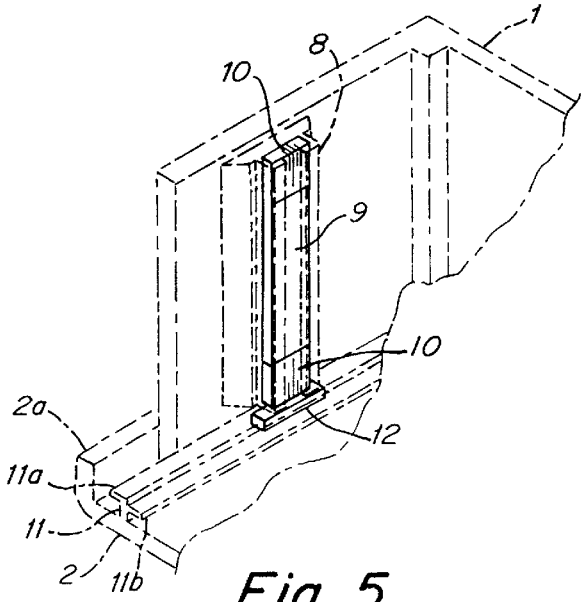
FIG. 5 is a partly perspective view showing a setting state of a magnet.
Figure 6:
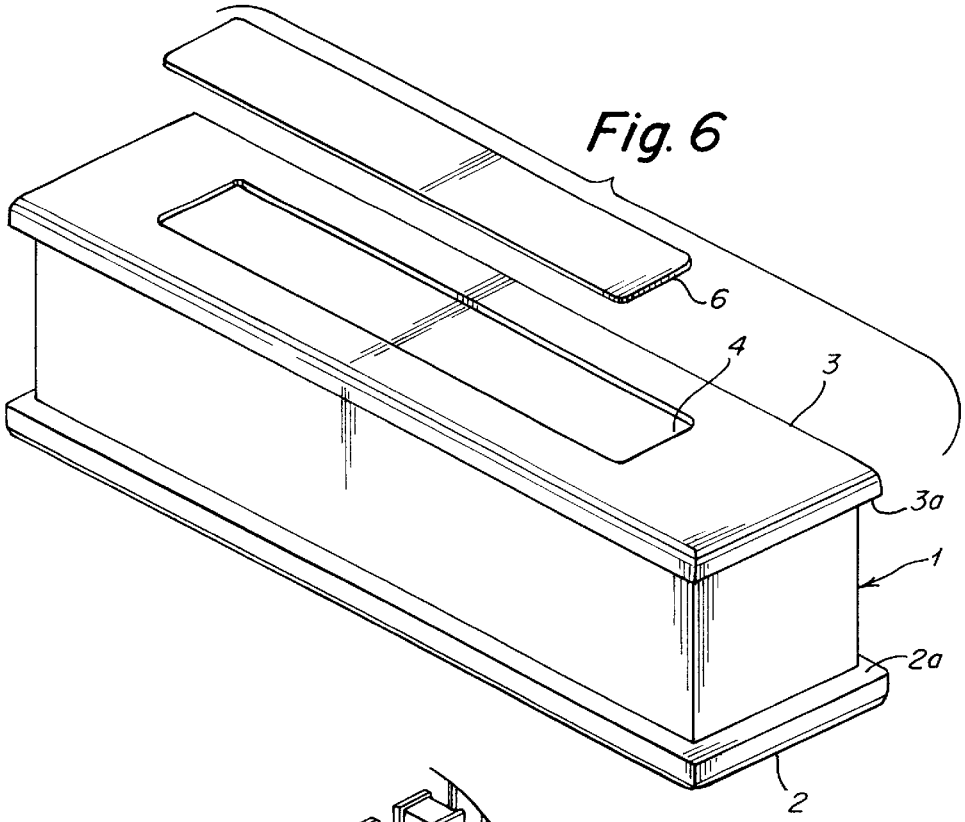
FIG. 6 is a perspective view in which the name plate is detached and brought away from the lid body.

In this embodiment, an Adam's apple and ashes are contained in the bag body 19 and subjected to vacuum treatment. The bag body 19 is provided at a part thereof with an excitation metal belt or at an opening chuck part thereof with magnetic powder. Such a metallic part 19*a* of the bag body 19 is shown in FIG. 2. The bag body 19 is suspended by the attraction of the magnetic body part with the plate-like magnet 16, and the other part of the bag body 19 is attracted by the oscillation preventing magnet 20. By doing so, the bag body 19 is attracted and retained in a stable manner by the oscillation preventing magnet 20.

Figure 7:
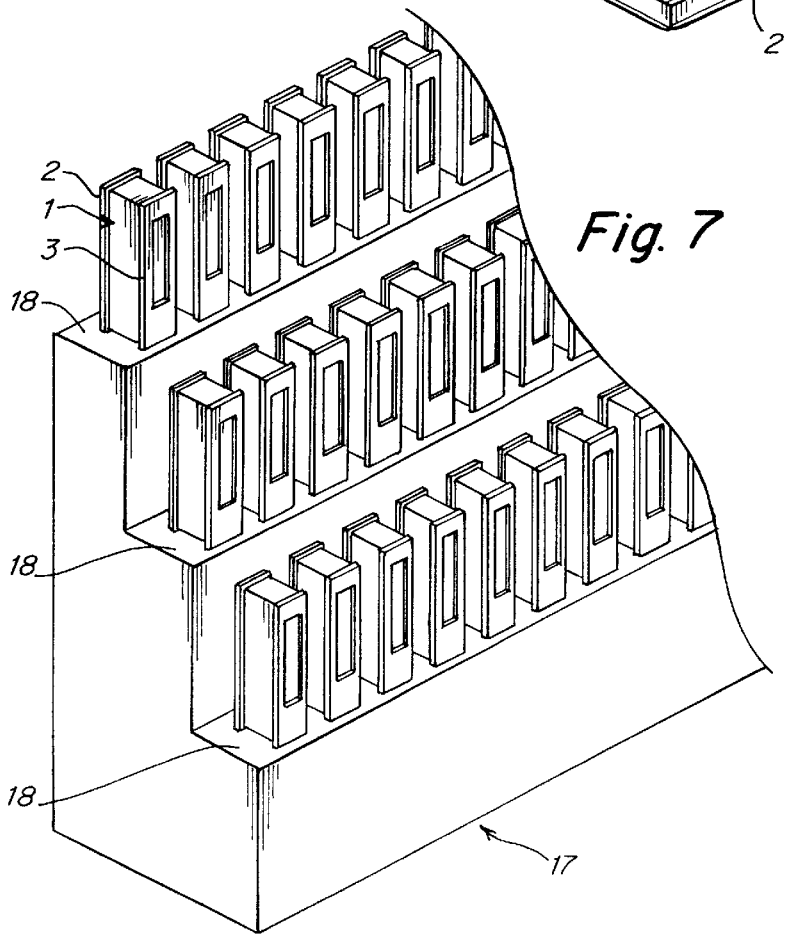
FIG. 7 is a partly perspective view showing a setting state of the magnet.

In this way, the cinerary container main body 1 containing the bag body 19 which contains ashes and bones can be placed, as shown in FIG. 7, in an erected state on a shelf part 18 of a cinerary alter 17. And by laying a magnetic metal plate or the like at least on the face of the shelf part 18, the cinerary container main body 1 can be attracted under the effect of the platelike magnet 14.

The cinerary container according to the present invention is constituted and used in the manner as described above, and enables the space necessary for setting (or placing) to be reduced as compared with the prior art, thus enabling an increased number of cinerary containers to be stored. Moreover, because metal is used as its raw material, recycling is made possible. Moreover, by virtue of its construction, the cinerary container according to the present invention can properly cope with quakes. In particular, bones contained in the bag body which is contained in the cinerary container main body are prevented from colliding with the inner wall face of the cinerary container main body and from rollingly moving within the main body.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims.

What is claimed is:

1. A cinerary container comprising:

a main body which is made of metal and one face of which is open, a magnet setting part formed on an inner wall side face of said main body, and a lid body for closing said open face of said cinerary container main body, wherein said magnet setting part includes a magnet which attracts said lid body and attracts a metallic part of a bag body which is adapted to contain ashes and bones.

2. A cinerary container according to claim 1, wherein said main body comprises a bottom plate body corresponding to said lid body.

3. A cinerary container according to claim 1, further comprising an oscillation preventive magnet which is adapted to attract at least one of an intermediate and a lower part of said bag body.

4. A cinerary container according to claim 3, wherein said oscillation preventive magnet is belt shaped.

5. A cinerary container according to claim 1, wherein a front face of the main body comprises a recess to which a name plate may be insertably fixed.

6. A cinerary container according to claim 1, wherein the main body is rectangular.

7. A cinerary container according to claim 1, wherein the bag body, except for the metallic part thereof, is made of plastic.

* * * * *